US005420766A

United States Patent [19]

Hollis

[11] Patent Number: 5,420,766

[45] Date of Patent: May 30, 1995

[54] DEFENSIVE LIGHT DEVICE

[76] Inventor: Bob J. Hollis, 10340 Hogue Rd., Evansville, Ind. 47712

[21] Appl. No.: 206,643

[22] Filed: Mar. 7, 1994

[51] Int. Cl.[6] ..... F21V 33/00

[52] U.S. Cl. ..... 362/96; 362/190; 362/205; 362/253; 222/113; 222/402.11

[58] Field of Search ..... 362/96, 101, 190, 205, 362/253; 222/192, 113, 402.11

[56] References Cited

U.S. PATENT DOCUMENTS

| | | | |
|---|---|---|---|
| 2,855,497 | 10/1958 | Bacon | 362/96 |
| 3,716,170 | 2/1973 | Mangels | 362/96 |
| 3,776,429 | 12/1973 | DeLucia | 362/96 |
| 4,186,851 | 2/1980 | Cantor | 222/113 |
| 4,247,844 | 1/1981 | Zapolski et al. | 362/96 |
| 4,434,914 | 3/1984 | Meshberg | 222/113 |
| 4,949,077 | 8/1990 | Mbuthia | 362/253 |
| 5,086,377 | 2/1992 | Roberts | 362/96 |

FOREIGN PATENT DOCUMENTS

| | | | |
|---|---|---|---|
| 2071300 | 9/1981 | United Kingdom | 362/190 |

*Primary Examiner*—Ira S. Lazarus
*Assistant Examiner*—Alan B. Cariaso
*Attorney, Agent, or Firm*—Hugh E. Smith

[57] ABSTRACT

A personal protective device comprising a combination flashlight, alarm and incapacitating spray mounted in a two section housing. A safety switch built into the unit prevents activation of the spray unless the flashlight is turned on. The unit has a strap to fasten to the user's wrist, such strap being designed to break away should an assailant grab the unit.

4 Claims, 4 Drawing Sheets

10
3
17
16
18
12
21
15
11
13
3
14

17
18
16
12

11

DEFENSIVE LIGHT DEVICE

BACKGROUND OF THE INVENTION

1. Field of the Invention

The present invention relates to personal protective devices and more particularly pertains to such a device which utilizes light, noise and an irritant spray to discourage an attacker.

2. Description of the Prior Art

The use of combination light, spray and alarm devices is known in the prior art. More specifically, such devices heretofore devised and utilized for the purpose of protection are known to consist basically of familiar, expected and obvious structural configurations, notwithstanding the myriad of designs encompassed by the crowded prior art which have been developed for the fulfillment of countless objectives and requirements. Typical devices of this type are illustrated in U.S. Pat. Nos. 3,776,429; 3,638,836; U.S. Pat. Des. Nos. 294,065 and 3,716,170.

Therefore, it can be appreciated that there exists a continuing need for new and improved protective devices which can be safely used by an individual. In this regard, the present invention substantially fulfills this need.

SUMMARY OF THE INVENTION

In view of the foregoing disadvantages inherent in the known types of protective devices now present in the prior art, the present invention provides an improved combination construction wherein the same can be utilized to discourage attack through light, noise and irritant spray. As such, the general purpose of the present invention, which will be described subsequently in greater detail, is to provide a new apparatus which has many of the advantages of the devices mentioned heretofore and many novel features that result in a combination which is not anticipated, rendered obvious, suggested, or even implied by any of the prior art devices, either alone or in any combination thereof.

To attain this, the present invention generally relates to a personal protective device comprising a combination flashlight, alarm and incapacitating spray mounted in a two section housing. A safety switch built into the unit prevents activation of the spray unless the flashlight is turned on. The unit has a strap to fasten to the user's wrist, such strap being designed to break away should an assailant grab the unit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal protection device which has many of the advantages of the devices mentioned heretofore and many novel features that result in a combination which is not anticipated, rendered obvious, suggested, or even implied by any of the prior art devices, either alone or in any combination thereof.

It is another object of the present invention to provide a new and improved personal protective device which may be easily and efficiently manufactured and marketed.

It is a further object of the present invention to provide a new and improved personal protective device which is of a durable and reliable construction.

An even further object of the present invention is to provide a new and improved personal protective device which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved defensive light personal protective device which provides in the apparatuses of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
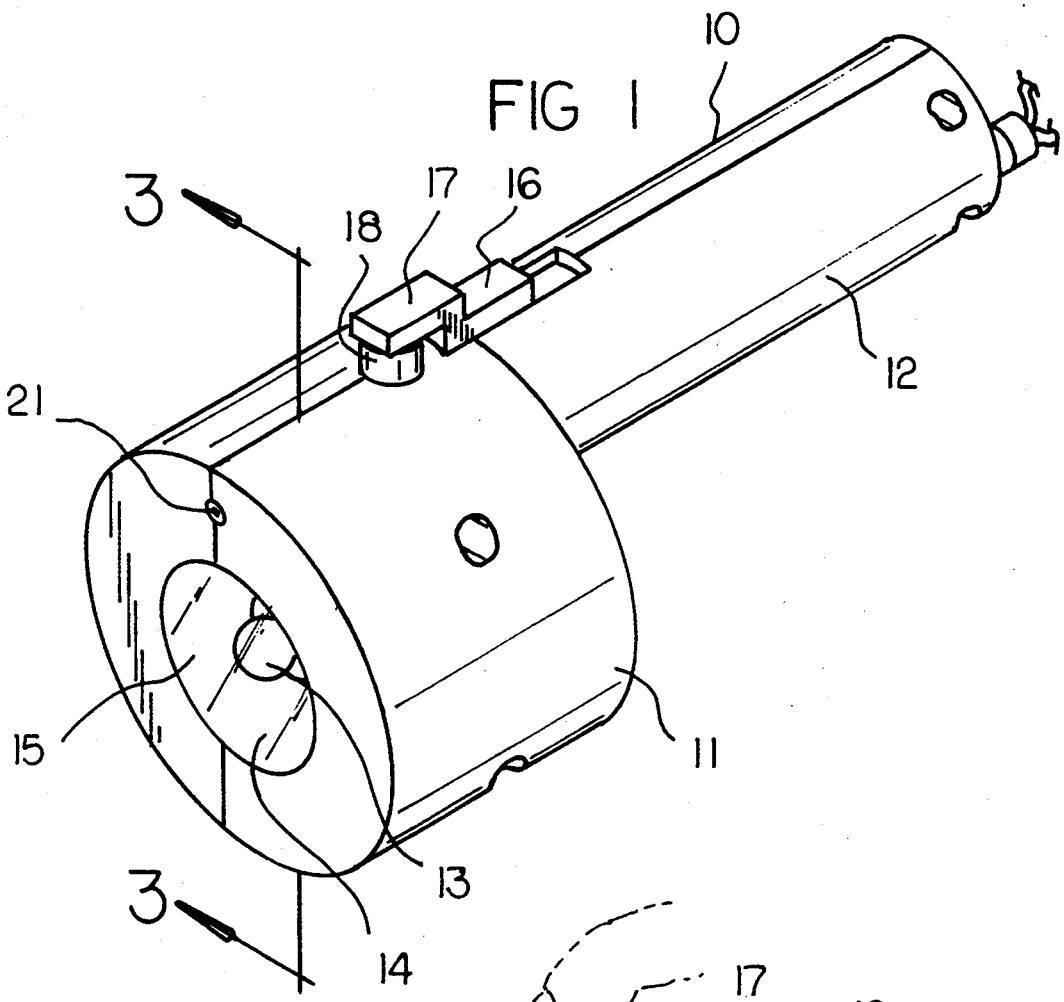
FIG. 1 is a perspective view of the device of the present invention.

With reference now to the drawings, and in particular to FIG. 1 thereof, a new and improved defensive light device embodying the principles and concepts of the present invention and generally designated by the reference numeral 10 will be described.

Figure 2:
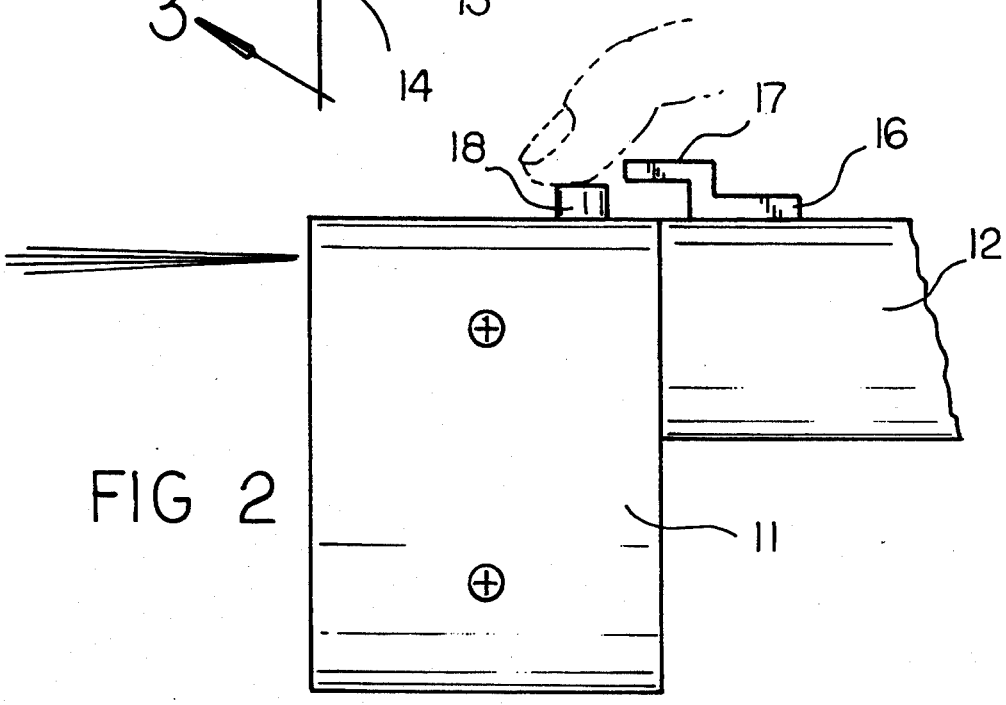
FIG. 2 is an enlarged perspective view of the head or forward end of the device of FIG. 1 showing the safety switch in the inoperative mode.

More specifically, it will be noted that the device 10 of the present invention consists of a two-part flashlight having a large diameter forward housing end 11 and a smaller hand grip housing end 12 attached to such forward end 11. Such forward end 11 is large enough to deny an attacker a one-hand grab thereof (substantially greater diameter than a conventional flashlight) and carries therein a flashlight bulb 13, reflector 14 and lens 15. Positioned atop forward end 11 is a slidable on-off switch 16 having a raised forward portion 17. In the "off" position shown in FIG. 1, such raised forward portion 17 extends over and prevents finger contact with a depressible button 18. As shown in FIG. 2, sliding switch 16 backwards into the "on" position for light bulb 13 frees button 18 to be pressed downwardly by the user's finger (shown in broken lines).

Figure 3:
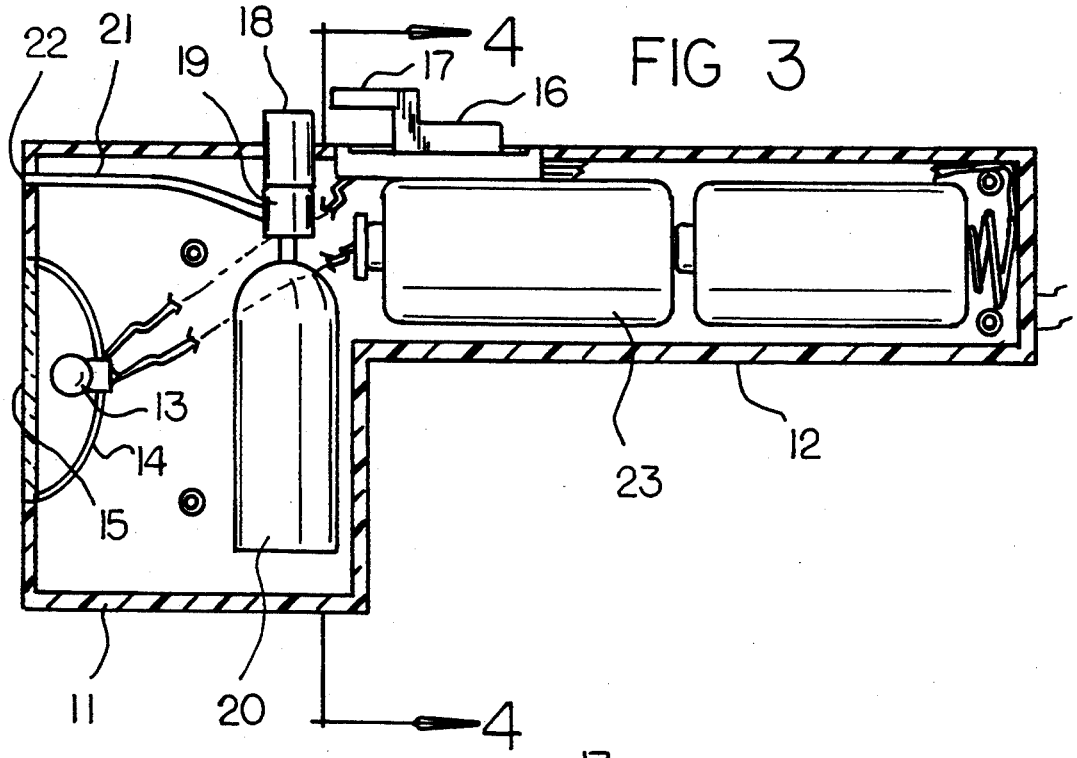
FIG. 3 is a sectional view on line 3—3 of FIG. 1.
Figure 4:
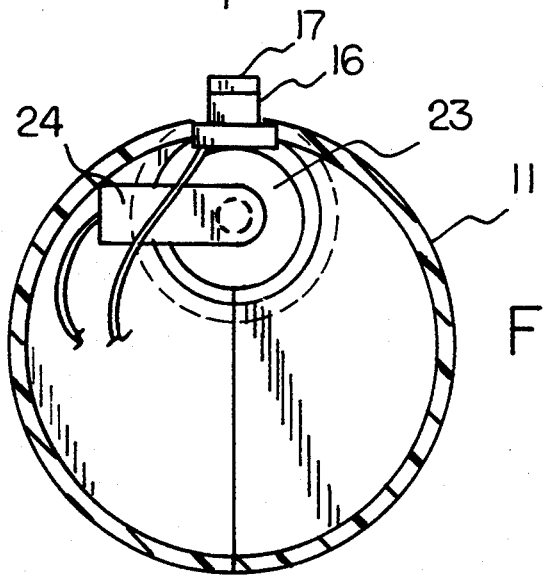
FIG. 4 is a sectional view on line 4—4 of FIG. 3.

As illustrated in FIGS. 3 and 4, depressing button 18 causes the activating button 19 on an aerosol spray can 20 of mace, pepper spray or other irritant to be energized releasing a spray of such irritant out through tubing 21 and nozzle 22. Switch 16 having to be in the "on" position to permit depressing button 18 means that the spray from nozzle 22 will follow the line of the light beam exiting lens 15 thus permit easy direction of such spray as desired. Batteries 23 for activating bulb 13 are carried in the hand grip housing end 12 of the device 10. As shown in FIG. 4, moving switch 16 into the "on" position engages a plate 24 with the terminal end of battery 14 causing current to flow through bulb 13.

Figure 5:
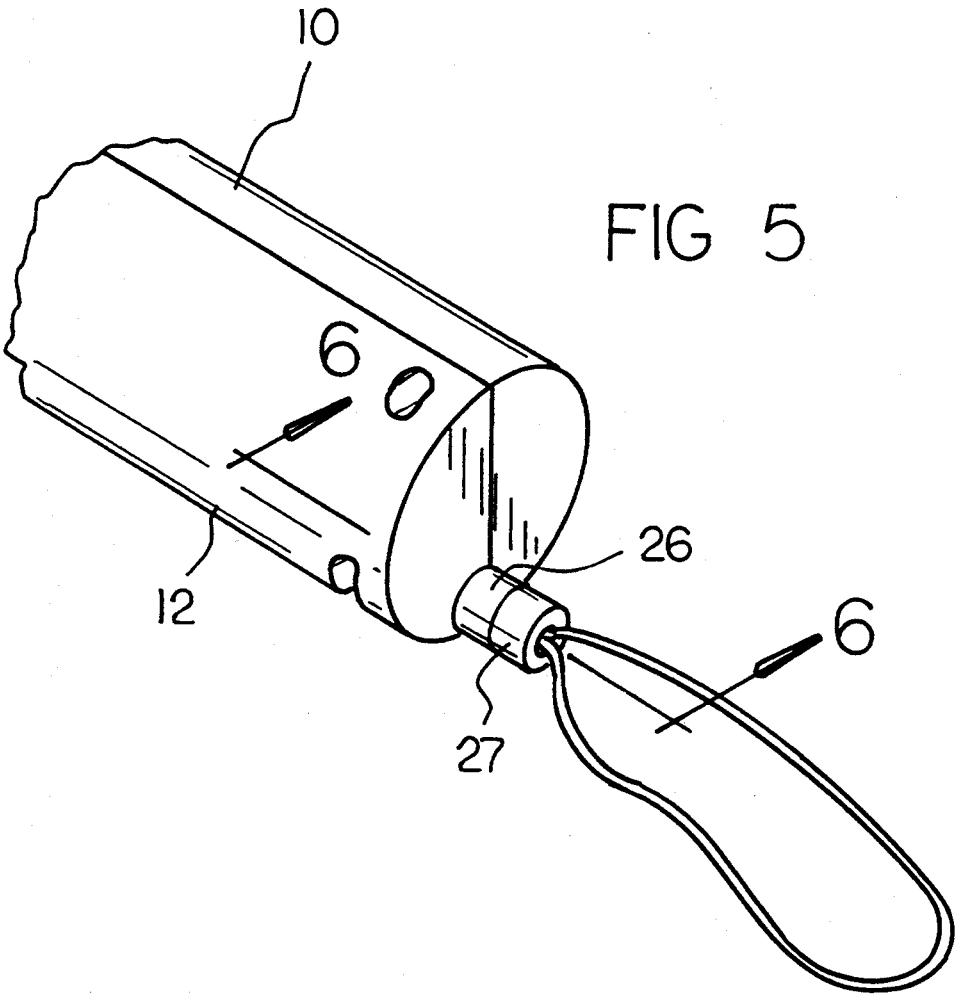
FIG. 5 is a perspective view of the back end of the device of FIG. 1.
Figure 6:
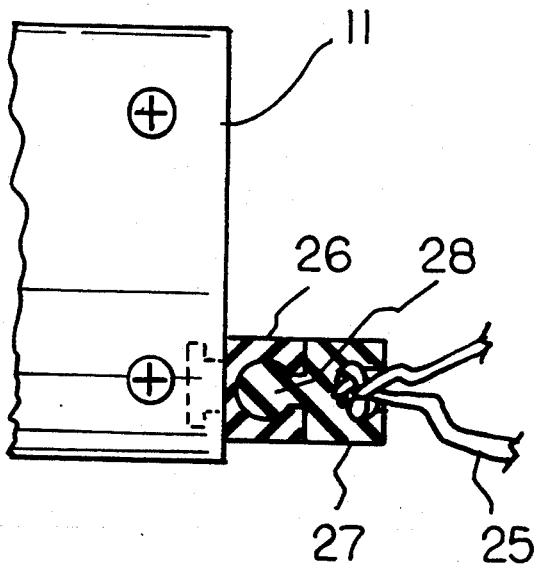
FIG. 6 is a partially sectional view of the break-away attachment of the strap shown in FIG. 5 to the housing of the device.

Although the enlarged forward housing end 11 of unit 10 makes it difficult for someone to grab such end 11, should such an event occur or should the unit 10 be dropped, a protective loop or wrist band 25 is fastened to the hand grip end 12 of the device as shown in FIGS. 5 and 6. Such loop 25 will prevent accidental dropping of the unit 10 but when excessive force is applied, i.e. in excess of 4 pounds of pressure, loop 25 is designed to separate from the unit 10 as shown in FIG. 6. Connecting loop 25 to the hand grip housing end 12 of unit 10 is a break away connector 26 fastened to housing end 12. Mating with connector 26 is a pull-out member 27 to which is affixed the loop or strap 25. An enlarged resilient plug 28 fitting into connector 26 will deform and release with 4 pounds pulling pressure.

Figure 7:
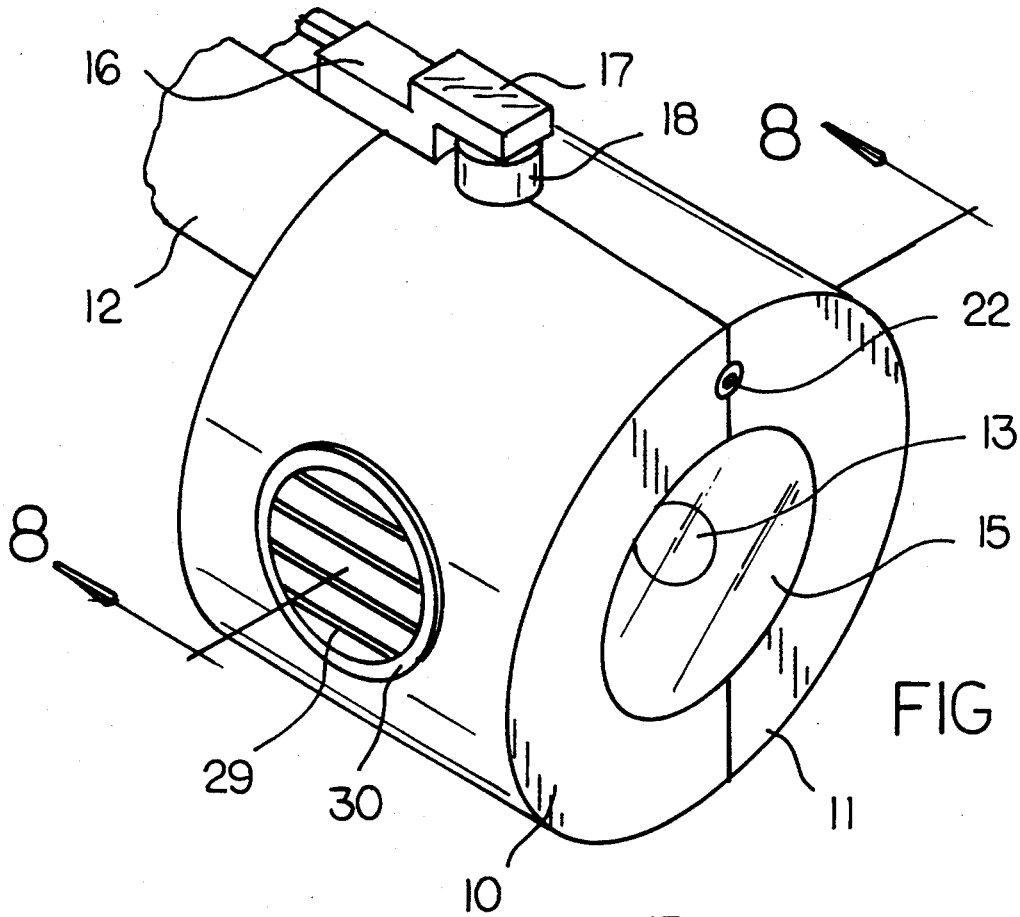
FIG. 7 is illustrates the incorporation of an audible alarm in the device of FIG. 1.
Figure 8:
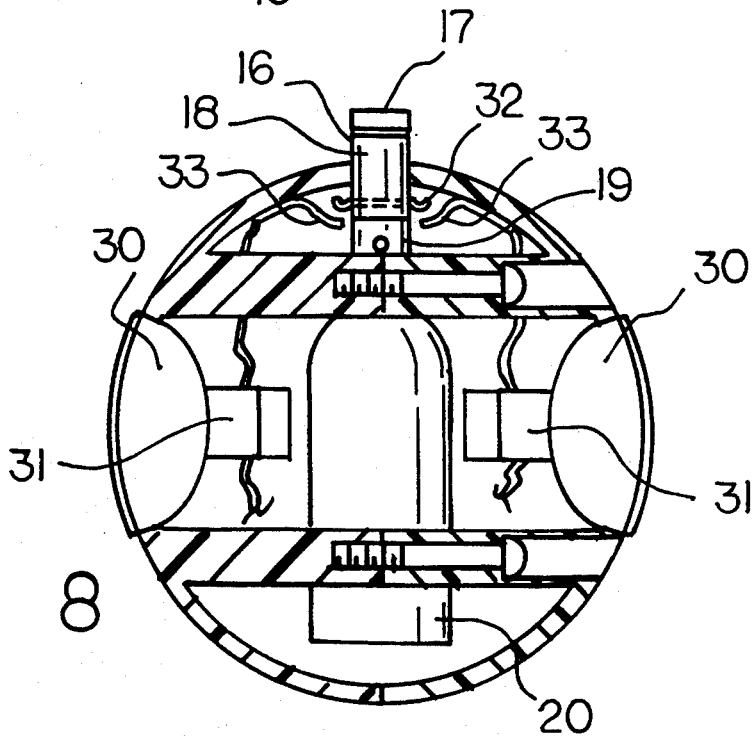
FIG. 8 is a sectional view on line 8—8 of FIG. 7.

Preferably the unit 10 also contains in addition to light 13 and spray 20, an audible alarm 29 shown in FIGS. 7 and 8 mounted within the enlarged forward end 11 of unit 10.

The speakers 30 for such alarm 29 extend through and are affixed to the walls of housing 11. Mounted internally of speaker 30 are a pair of loud buzzers or other noise generators 31. Affixed to button 18 and movable therewith are a pair of electrical contactors 32 adapted to engage with wires 33 from buzzers 31 when button 18 is depressed.

The combination of light, noise and irritant spray will discourage almost any attacker.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved defensive light device which comprises: a forward housing end having a predetermined diameter; a hand grip housing of a further diameter smaller than said predetermined diameter and extending rearwardly of and affixed to said forward housing end; a flashlight bulb, reflector and lens mounted within said forward housing to project light forwardly therefrom; an irritant-containing aerosol can also mounted within said forward housing; means connecting said aerosol can to a spray nozzle projecting forwardly from said forward housing end; a downwardly movable button projecting from an upper surface of said forward housing end, said button when depressed activating said aerosol spray can; a horizontally slidable switch slidably received on the upper surface, said switch having a raised forward portion extending over and preventing contact with said downwardly movable button only when said switch is in a forward position with said forward portion extending over said button; and batteries and associated wiring carried within said smaller hand grip housing connecting with said switch and said flashlight bulb for activating said bulb when said switch is in a retracted position and said forward portion is spaced from said button.

2. A light device as in claim 1 wherein an audible alarm is also positioned within said forward housing and is activated by depressing said downwardly movable button.

3. A light device as in claim 1 wherein a break away wrist strap is affixed to the rearward end of said hand grip housing, said break away strap separating from said housing under an applied pressure of over four pounds.

4. A new and improved defensive light device which comprises: a forward housing end having a predetermined diameter; a hand grip housing of a further diameter smaller than said predetermined diameter and extending rearwardly of and affixed to said forward housing end; a flashlight bulb, reflector and lens mounted within said forward housing to project light forwardly therefrom; an irritant-containing aerosol can also mounted within said forward housing; means connecting said aerosol can to a spray nozzle projecting forwardly from said forward housing end; a downwardly movable button projecting from an upper surface of said forward housing end, said button when depressed activating said aerosol spray can; a horizontally slidable switch slidably received on the upper surface, said switch having a raised forward portion extending over and preventing contact with said downwardly movable button only when said switch is in a forward position with said forward portion extending over said button; and batteries and associated wiring carried within said smaller hand grip housing connecting with said switch and said flashlight bulb for activating said bulb when said switch is in a retracted position and said forward portion is spaced from said button; an audible alarm is also positioned within said forward housing and is activated by depressing said downwardly movable button.

* * * * *